United States Patent [19]

Sheppard, Jr. et al.

[11] Patent Number: 4,616,453

[45] Date of Patent: Oct. 14, 1986

[54] LIGHT GAUGE STEEL BUILDING SYSTEM

[76] Inventors: Isaac Sheppard, Jr., 1030 W. Elmwood, Clawson, Mich. 48017; Everett Jewell, 1302 Gaston Way, Dallas, N.C. 28034; Steven E. Levitz, 5108 Chestershire Ct., West Bloomfield, Mich. 48033; Rudolph T. Taylor, 512 N. Vermont, Royal Oak, Mich. 48067

[21] Appl. No.: 380,446

[22] Filed: May 20, 1982

[51] Int. Cl.[4] ..... E04B 7/02

[52] U.S. Cl. ..... 52/93; 52/639; 52/693; 52/475

[58] Field of Search ..... 52/639, 643, 690, 92, 52/90, 93, 693

[56] References Cited

U.S. PATENT DOCUMENTS

| | | | |
|---|---|---|---|
| 1,451,555 | 4/1923 | Schenstrom | 52/639 X |
| 2,439,960 | 4/1948 | Auten | 52/90 |
| 2,541,784 | 2/1951 | Shannon | 52/90 |
| 2,989,154 | 6/1961 | Colby, Jr. | 52/643 X |
| 3,019,861 | 2/1962 | Rasch et al. | 52/639 |
| 3,157,251 | 11/1964 | Rasch | 52/643 X |
| 3,352,070 | 11/1967 | Raynes | 52/639 X |
| 3,999,352 | 12/1976 | Doke | 52/690 |

*Primary Examiner*—Carl D. Friedman

*Attorney, Agent, or Firm*—Leydig, Voit & Mayer, Ltd.

[57] ABSTRACT

A light gauge steel building wherein a plurality of roof trusses are supported by wall studs located in lower track sections. The roof trusses include a plurality of tension and compression members which overlap the truss top and bottom chords so that extra reinforcing plates are unnecessary. Single or double thickness wall siding may be provided as structurally required, and the siding is fastened to horizontal girts which are mounted on, and span, the vertical wall studs. Provision is also made for both load bearing and non-load bearing doorway openings. Light gauge steel members are used throughout the building system to reduce overall weight, and yet maintain structural integrity.

20 Claims, 31 Drawing Figures

Fig. 4.
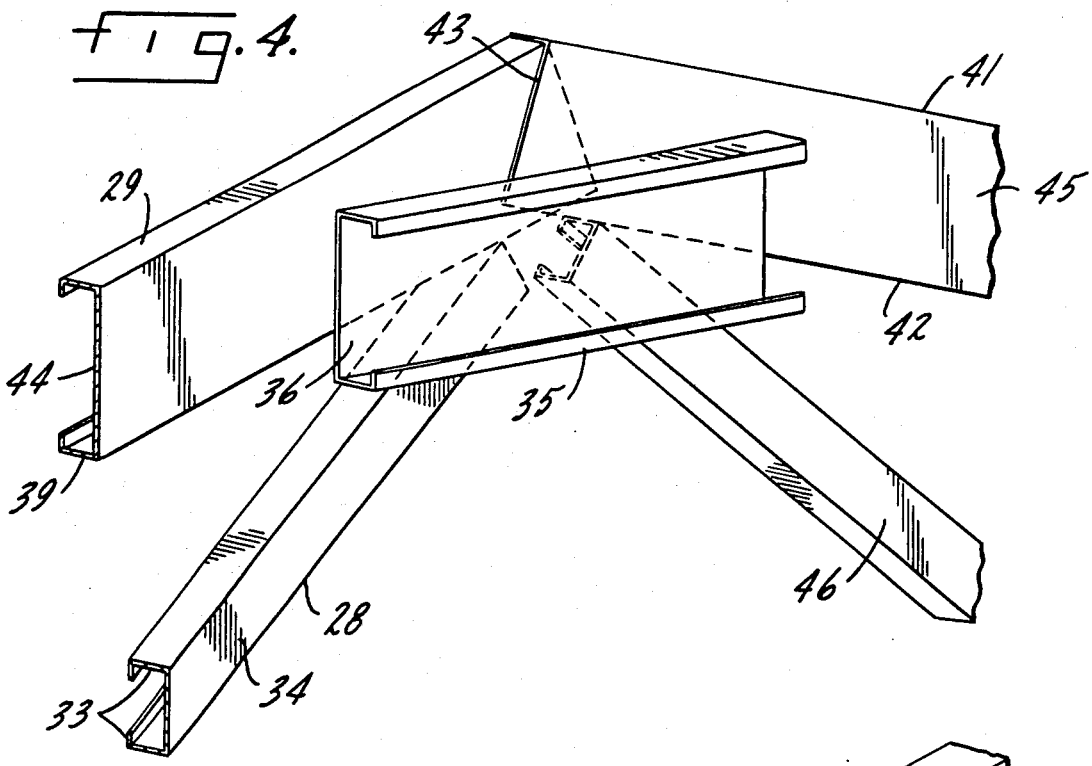
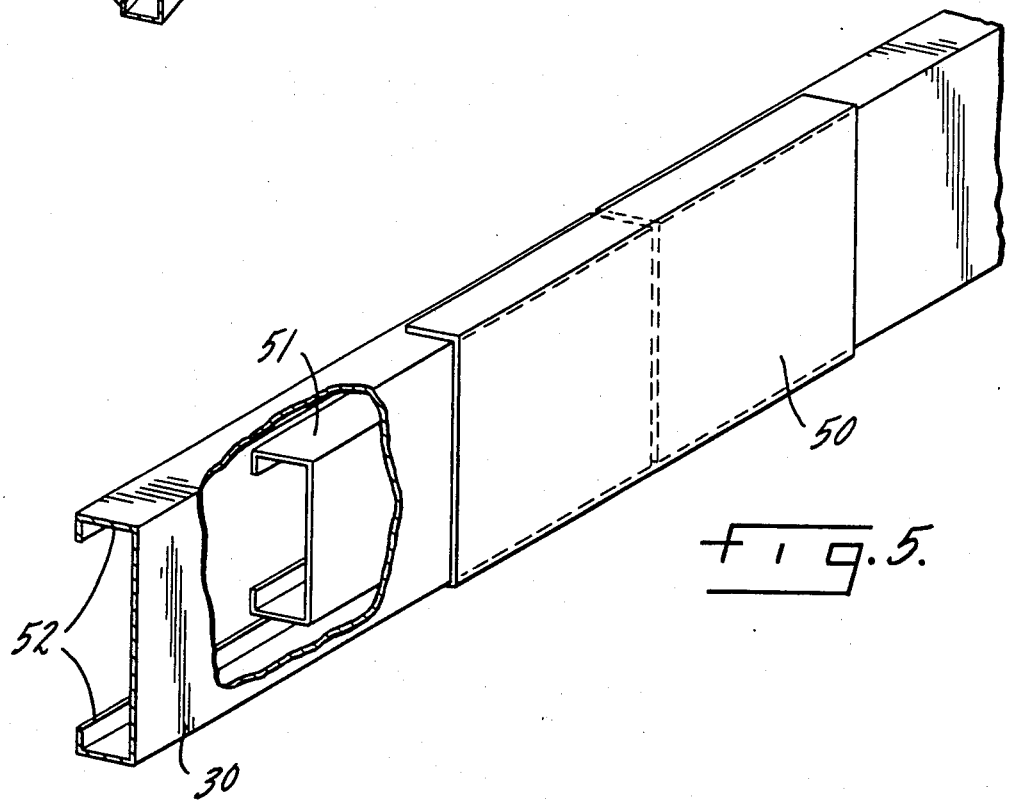
Fig. 5.

Fig. 23.
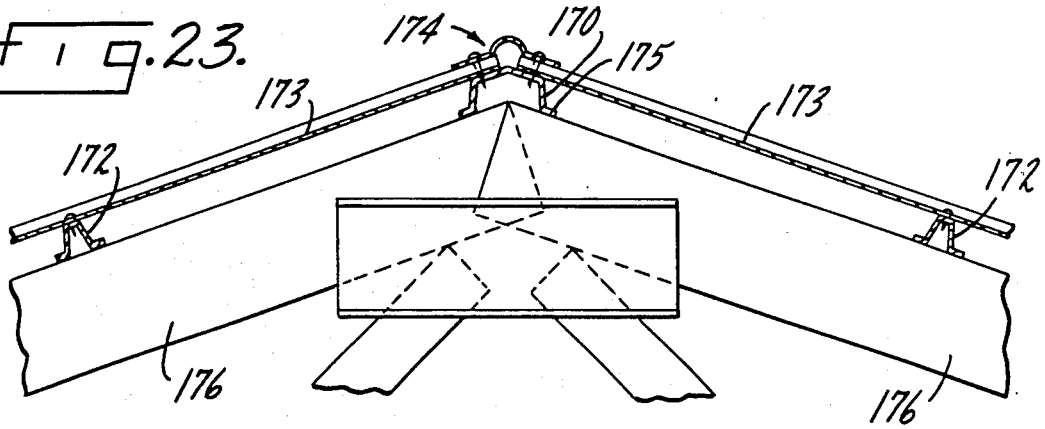
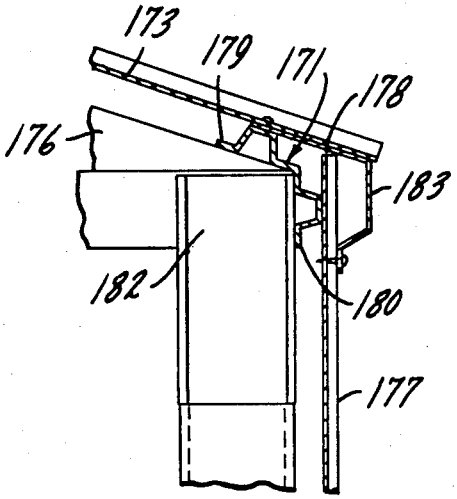
Fig. 24.
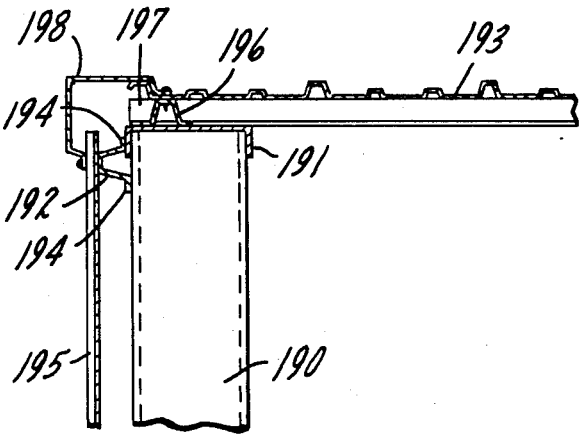
Fig. 25.
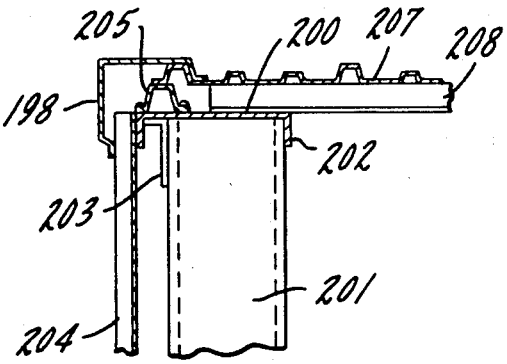
Fig. 26.
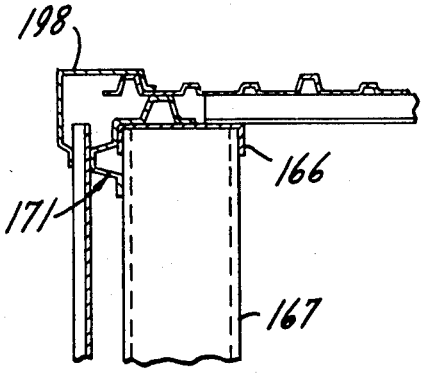
Fig. 22.

LIGHT GAUGE STEEL BUILDING SYSTEM

FIELD OF THE INVENTION

The present invention relates generally to building systems where the component parts of the building are comprised of various light gauge steel parts. The building includes a number of elements, which when combined, provide a building system which has fewer component parts than comparable buildings, yet is easier to assemble and has superior strength characteristics compared with other building arrangements.

BACKGROUND OF THE INVENTION

The prior art contains numerous examples of various types of steel building systems which incorporate truss members, sheet metal wall and roof systems, various studs or joists, and various methods of fastening the numerous parts together. Typically, such buildings are constructed of relatively heavy gauge material and require a considerable number of reinforcing members in addition to a large number of fastening devices, such as screws, bolts, and turnbuckles. Such buildings are not only expensive to build because they are labor intensive, but the extra parts add to assembly sequence and inventory problems.

SUMMARY OF THE INVENTION

The light gauge steel truss building system of the present invention includes inter alia a number of truss members which are comprised of chords, compression members, and tension members. The chord members are arranged so that they intersect with one another while the compression members and the tension members overlap the chords, all of which eliminates the requirement for using numerous gussets as in other buildings. Pursuant to the invention, a wall system is provided which includes a number of steel sheets securely fastened to wall studs. Between the steel sheets and the wall studs are a number of support spacers, or girts, which provide uniform spacing between the outside wall of the building and the wall studs, and also add structural strength to the walls. In addition, girts or purlins are provided where the roof sections meet the exterior wall, and also where the roof sections meet at the peak of the roof.

OBJECTS OF THE INVENTION

It is, accordingly, a primary object of the present invention to provide an economical, light gauge steel building system.

It is another object of the present invention to provide light gauge building components with overlapping joints to reduce the number of connections where various members intersect.

Another object is to provide selective reinforcing of truss chords by using separate caps or base channels to increase the strength of the respective chords where required.

It is a further object to provide symmetrical and interchangeable parts to simplify part inventory and reduce fabrication errors. Additionally, it is an object to make assembly considerably easier by not having to worry about right or left hand parts, or which end of a part fits with another part. To this end, various parts will either fit as intended, or not at all.

Other objects and advantages of the invention will become apparent upon reading the attached detailed description and upon reference to the drawings, in which:

BRIEF DESCRIPTION OF DRAWINGS

FIG. 4 is a partial perspective view of the intersection of the top chords at the ridge of the building.

FIG. 5 is a perspective view of a typical bottom chord splice, partially broken away to show a splice channel.

FIG. 22 is a partial cross sectional view of a gable purgirt and track section running along the top of the gable studs.

FIG. 23 is a partial cross sectional view of a ridge purlin tying the roof sections to the top chords of the roof truss.

FIG. 24 is a partial cross sectional view of an eave purgirt tying the roof section to the side wall where the latter two meet at the eave.

FIG. 25 is a partial cross sectional view of a track section with a girt used for wall spacing and continuous sections of purlins for extra support.

FIG. 26 is a partial cross sectional view of a modified wide track section with a clip for mating the side wall along the gable.

While the invention will be described in connection with certain preferred embodiments, it will be understood that we do not intend to be limited to the particular embodiments shown but, on the contrary, intend to cover such alternative forms and embodiments as may be included within the spirit and scope of the appended claims.

Figure 1:
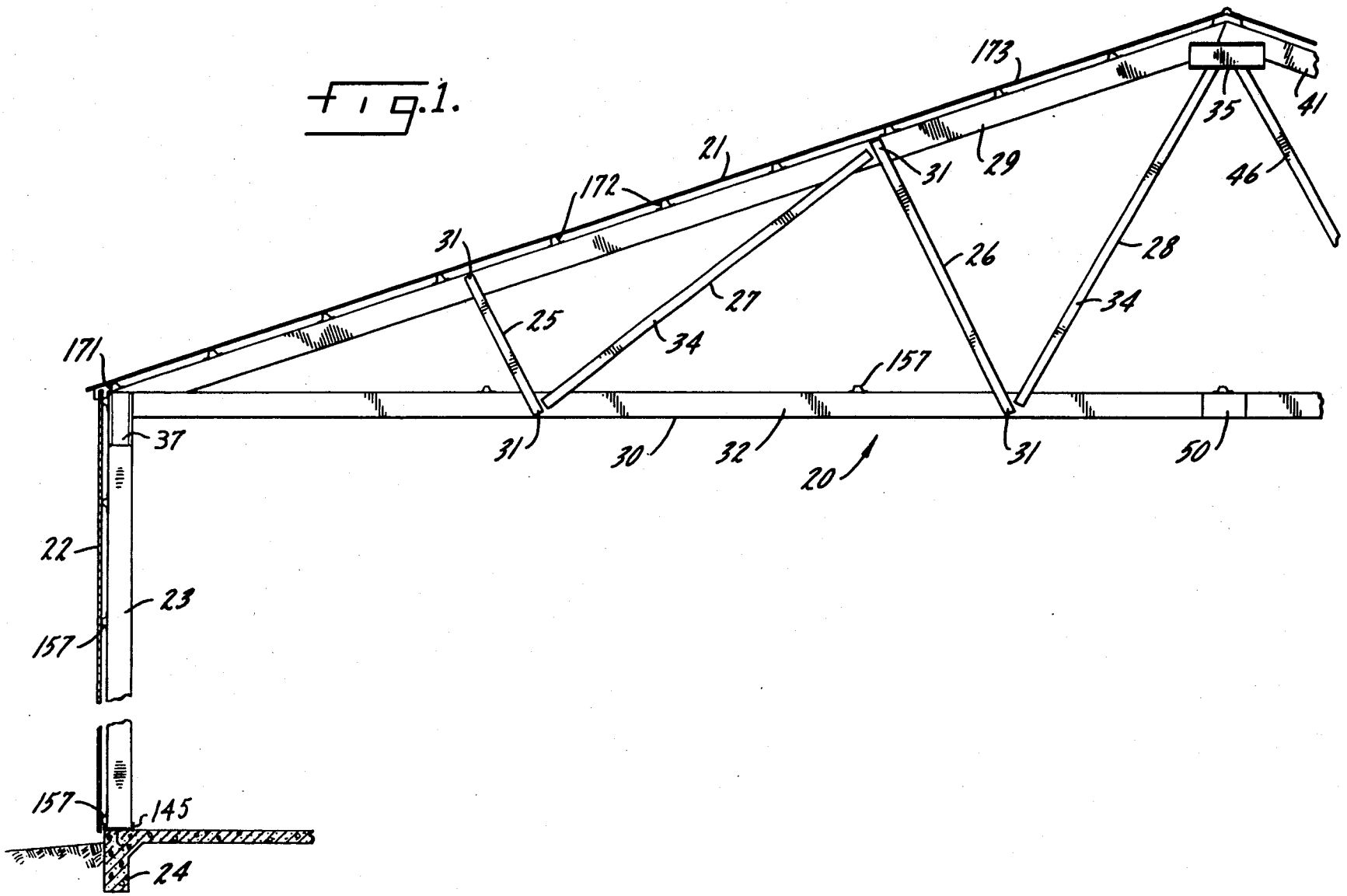
FIG. 1 is a partial cross sectional view of a typical building showing truss and wall sections with the truss including top and bottom chords and both tension and compression members.

Turning to FIG. 1 there is shown a partial side elevational view of a light gauge steel building which includes a truss section 20, roof sheeting 21, wall sheeting 22, a stud or joist 23, and a concrete foundation 24. The truss section 20 is representative of a typical truss section which would include tension members, compression members, and a plurality of top and bottom chords. Depending upon the size of the building, the lengths of the various chords as well as the number of tension and compression members will vary as necessary to provide the required structural strength with an acceptable safety factor. The illustrative truss section 20 has two compression members 25 and 26 and two tension members 27 and 28. In addition, truss section 20 includes a top chord 29, which is in compression, and a bottom chord 30 which is in tension. Other smaller truss sections may not include as many tension or compression members because the truss will span a much shorter distance. Similarly, larger truss sections may contain more tension and compression members because the truss will span a longer distance.

Generally speaking, it is desirable to have the various truss section members comprised of generally channel or C-section frame members, with the members being of differing cross sectional sizes depending upon the length of the member as well as the load forces which it will incur.

Figure 2:
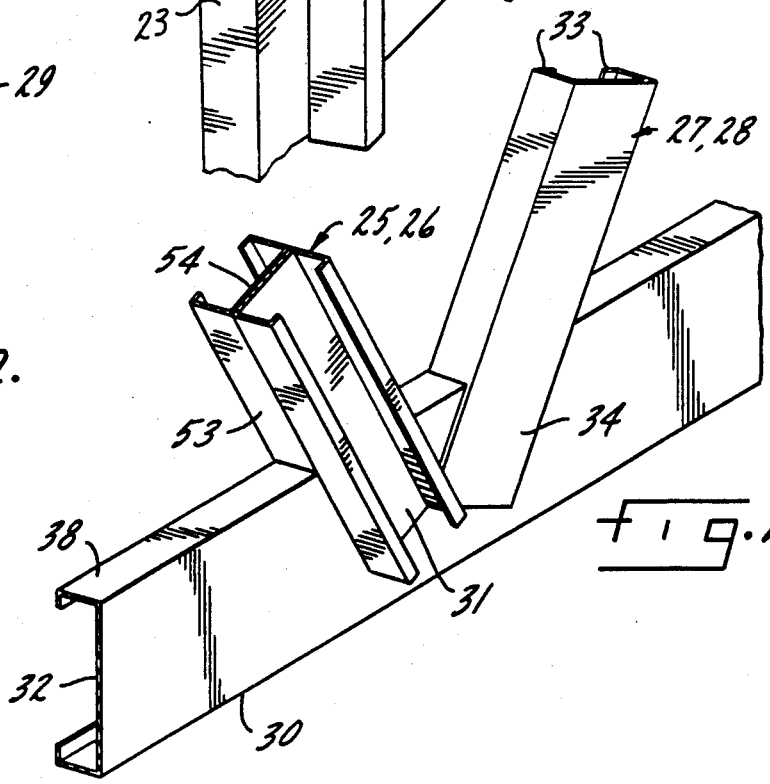
FIG. 2 is an enlarged partial perspective view showing how typical compression and tension members tie into a bottom chord member.

In keeping with one aspect of the invention, and as shown in detail in FIG. 2, the respective compression members 25 and 26 overlap bottom chord 30 so that the web sections 31 of compression members 25 and 26 mate with web section 32 of the bottom chord 30. On the other hand, the flanges 33 of the respective tension members 27 and 28 are cut away from the web section 34 in the area where the tension members overlap the bottom chord 30. The same overlapping relationship exists between compression members 25 and 26 and top chord 29, and also between tension member 27 and top chord 29. Preferably, however, tension member 28 does not overlap the top chord 29, but instead overlaps with reinforcing gusset channel 35 at the peak of the truss section. Where tension member 28 and reinforcing channel 35 overlap, the tension member web section 34 mates with web section 36 of the reinforcing channel. It should be noted that only one-half of the truss section 20 is shown in FIG. 1, but the other half of the truss section is intended to be symmetrical with that which is shown.

Figure 3:
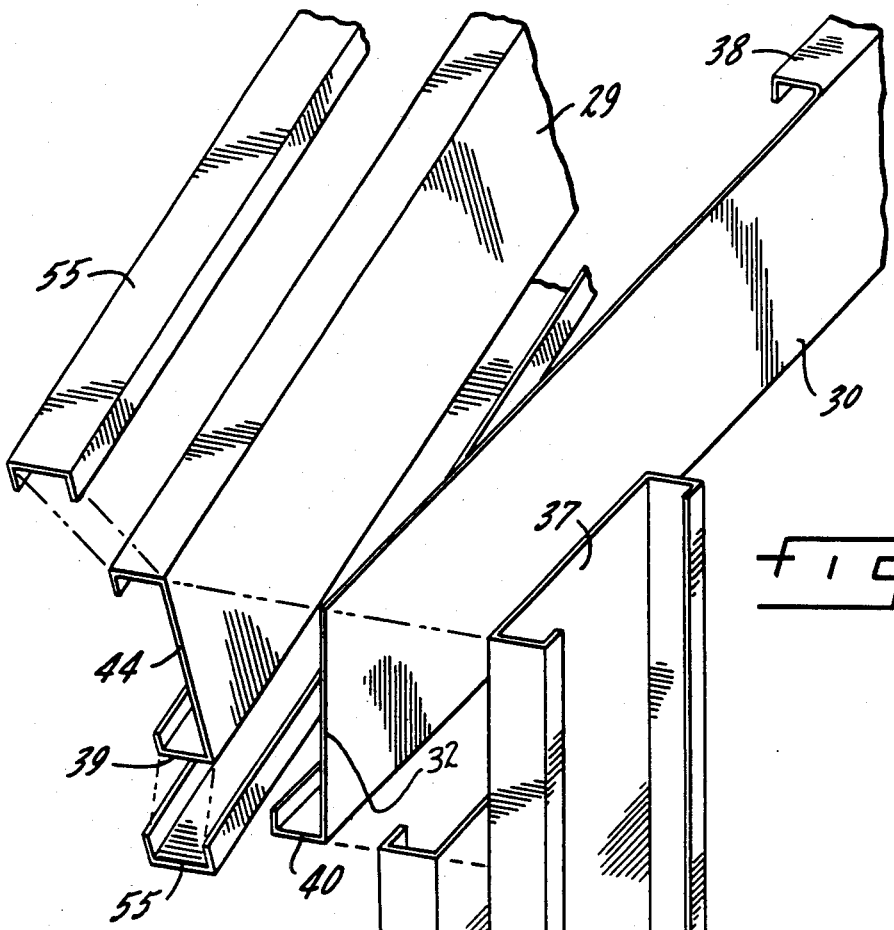
FIG. 3 is an exploded perspective view showing the mating relationship between the top and bottom chords where they mate with a truss leg connector.

In FIG. 3, the web section 32 of bottom chord 30 mates the flat surface of truss leg connector 37. A notch is cut into the top flange 38 of the bottom chord a sufficient distance to allow top chord 29 to intersect bottom chord 30. The bottom flange 39 of top chord 29 does not intersect bottom flange 40 of bottom chord 30 but merely rests on it.

Turning to FIG. 4, at the peak of truss section 20, top chord 29 intersects with top chord 41. The bottom flange 42 of top chord 41 is notched or cut back a distance from the end 43 of the chord. It will be appreciated that the actual length of the notched section depends upon the angle at which the top chord 29 and top chord 41 meet each other. Web section 44 of top chord 29 then mates against web section 45 of top chord 41. Web section 36 of the reinforcing element 35 mates with web sections 44 and 45 of the chords 29, 41 and, as will be described in detail below, the reinforcing channel 35 is securely fastened to the top chord 29 and top chord 41. It should also be noted that top chord 29, top chord 41, and tension members 28 and 46 are all essentially in the same plane while web section 36 of the reinforcing channel 35 faces and mates with the web sections of those various members, i.e., reinforcing channel 35 is the only member which is out of plane at the peak of truss section 20.

Depending upon the overall size of the buildings, it may be possible to construct truss section 20 with a single bottom chord 30. However, with larger buildings it will be necessary to have a bottom chord 30 comprising more than one section. As shown in FIG. 5, where it is necessary to build a truss section which incorporates more than one bottom chord member, the chords are spliced by means of outer splice track 50 and inner splice channel 51. The inner splice channel 51 is typically a C-section member which is identical in shape to bottom chord 30, except that inner splice channel 51 is smaller so that it is positioned inside flanges 52 of the bottom chord. Outer splice track 50, depicted in FIG. 5, wraps around the outside of bottom chord 30 in the area of the splice. Both outer splice track 50 and inner splice channel 51 extend a short distance on either side of the splice but do not extend the entire length of any bottom chord.

In order to insure that the design safety factor is maintained, it may be necessary to reinforce various members of truss section 20. For example, compression member 25 or 26 may require a doubler channel 53 for reinforcement as shown in FIG. 2. The web section 54 of doubler channel 53 faces and mates with web section 31 and the doubler channel 53 extends between top flange 38 and bottom flange 39 of the chords, i.e., doubler channel 53 does not overlap the chords.

Another area which may require localized reinforcing is where the top chord 29, bottom chord 30, and the truss leg connector 37 intersect. For this purpose, it may be necessary to incorporate a flange channel 55 on the top or bottom of top chord 29 as shown in FIG. 3.

Figure 3A:
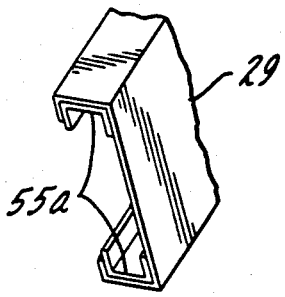
FIG. 3*a* is a partial exploded perspective view showing the relationship of reinforcing members and the chords.

Preferably, flange channel 55 wraps around the respective flanges of the chord and extends a short distance along web section 44. As an alternate, an integral flange channel 55*a* of a smaller size may be used as shown in FIG. 3*a*. To keep any extra weight to a minimum, flange channel 55 extends a distance along top chord 29 only far enough to accomplish the desired reinforcement.

Figure 6:
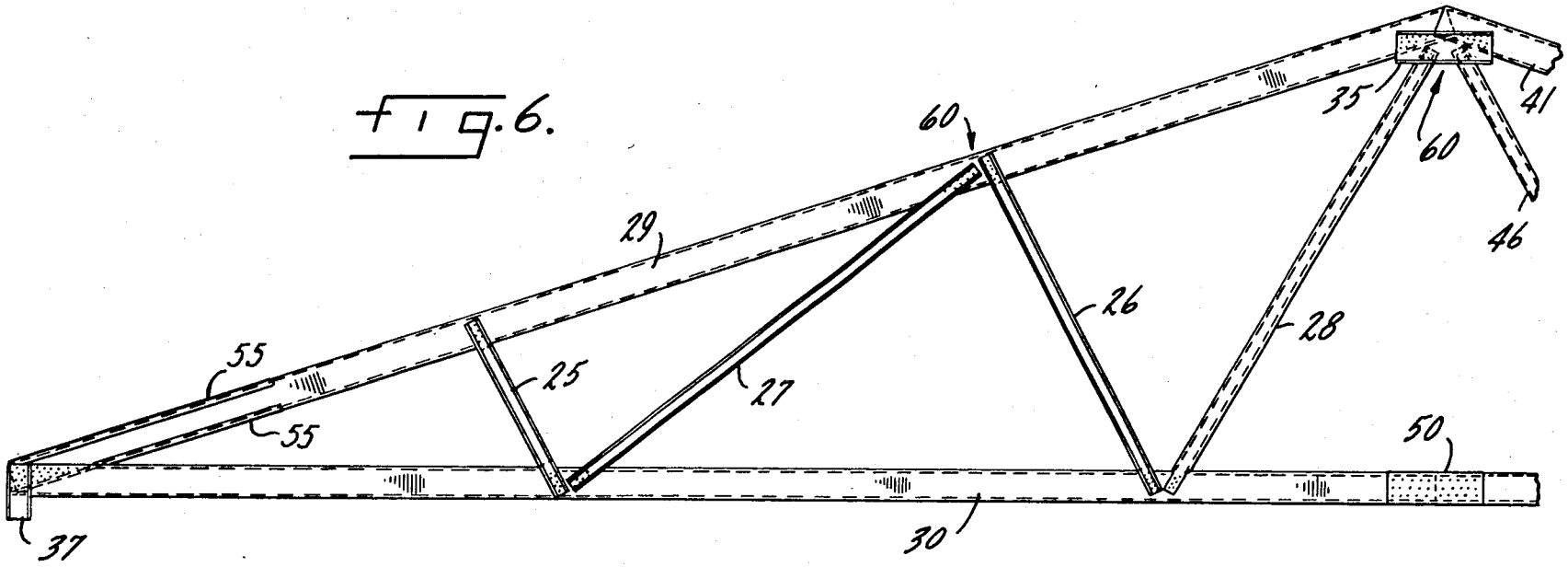
FIG. 6 is a partial elevational view of a typical truss section showing a particular screw spacing pattern.
Figure 8:
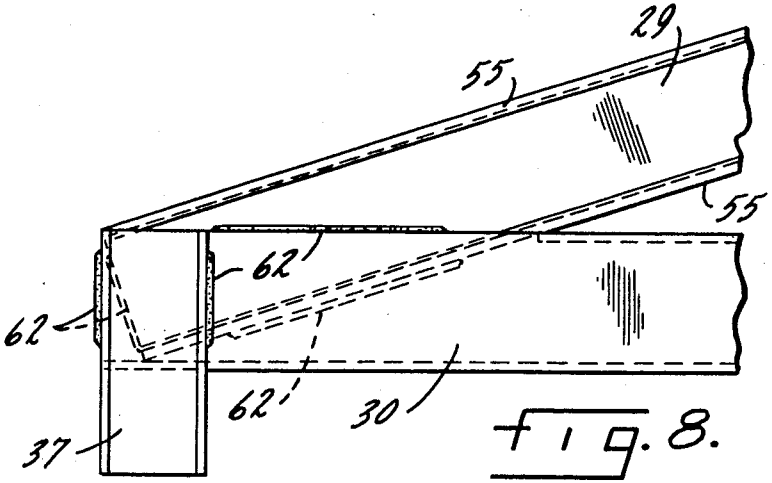
FIG. 8 is an enlarged partial elevation of a truss section showing in detail the desired weld lines where the chords meet a truss leg connector.
Figure 7:
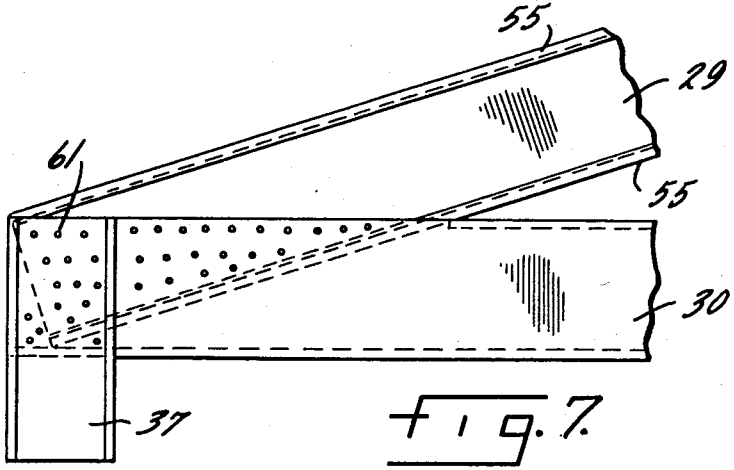
FIG. 7 is an enlarged partial elevation of a truss heel section showing in detail the desired screw spacing pattern.

The various truss members may be fastened to one another in the areas where they overlap by any one of several conventional fastening means. For example, in FIG. 6 there is shown a screw pattern 60 for fastening the overlapping joints. It is desired that all screws 61 (see FIG. 7) be of the self-drilling, self-tapping, threaded fastener type. As an alternative, the overlapping members may be spot welded in approximately the same locations as shown by the screw pattern. A still further alternative is shown in FIG. 8, where the overlapping members are connected by flare-bevel groove welds 62 which are located between the outside radius of the member and the flat of the other member. All welding should comply with the provisions of the Code for Welding in Building Construction or the Special Ruling on Gas Metal-Arc Welding with Carbon Dioxide Shielding of the American Welding Society.

Figure 9:
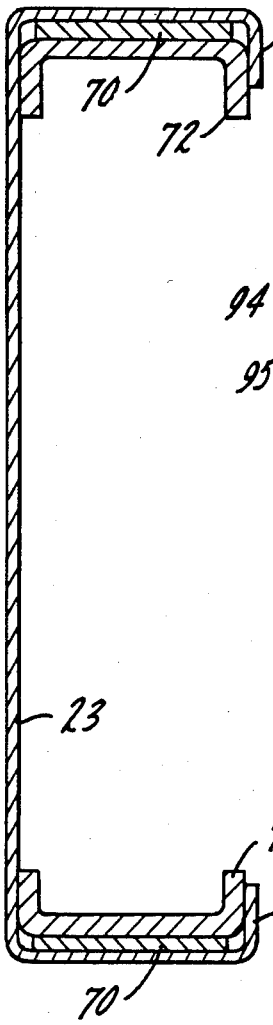
FIG. 9 is an enlarged cross sectional view of a wall stud with localized reinforcing members.
Figure 10:
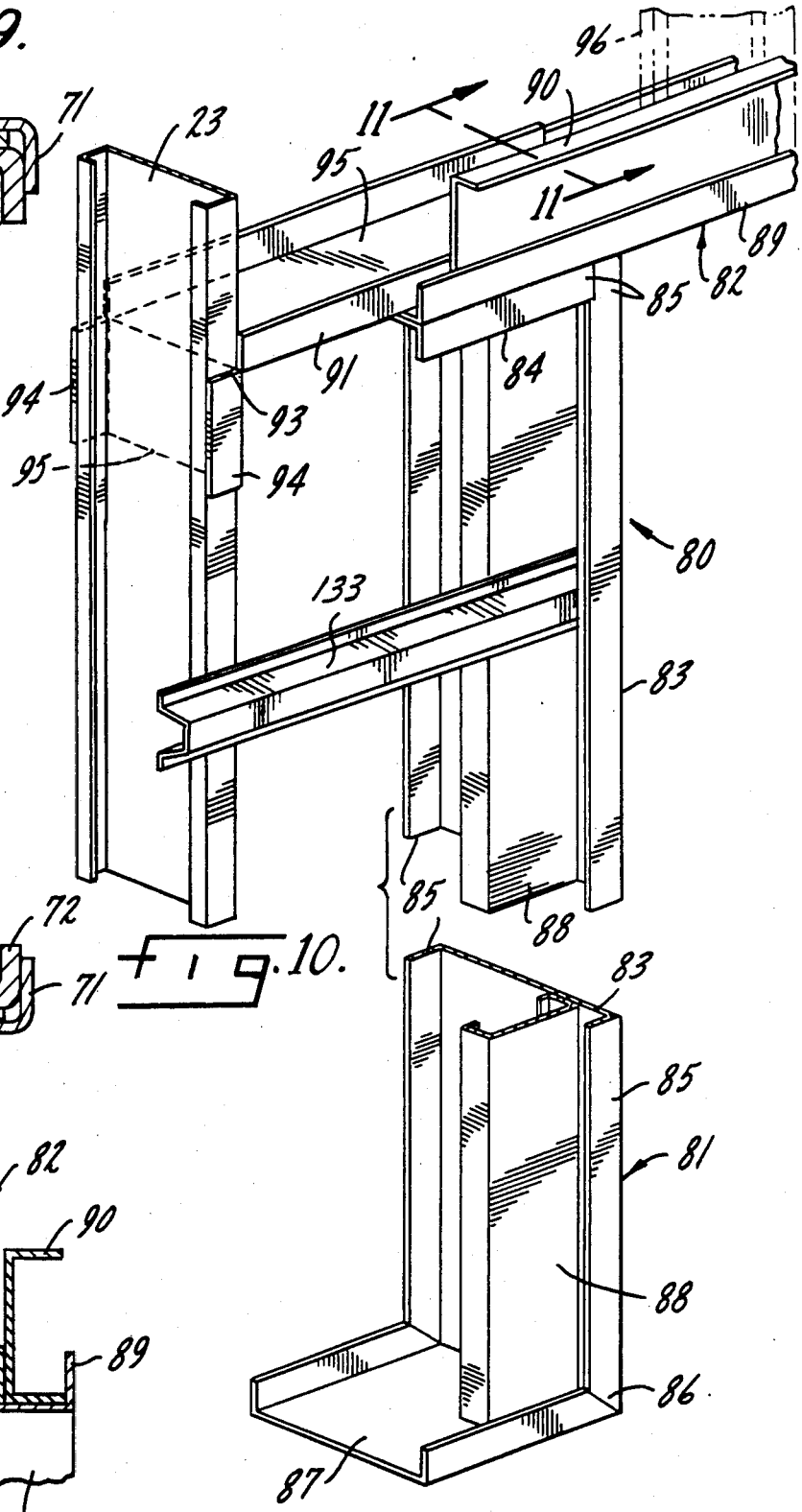
FIG. 10 is a partial perspective view of non-load bearing door jamb and header.
Figure 11:
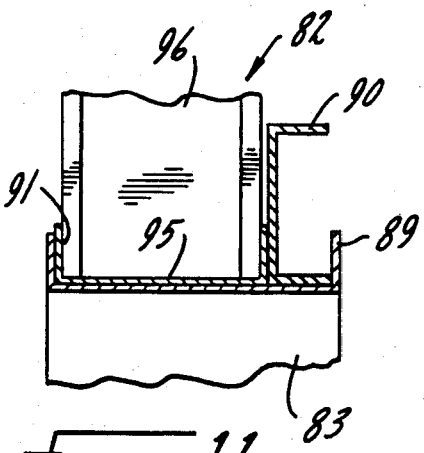
FIG. 11 is a cross sectional view taken substantially along line 11—11 in FIG. 10 showing the header section which spans the doorway.

The roof and sidewalls of the building are supported by a number of studs 23 (or joists) which are spaced at predetermined intervals around the perimeter of the building. In the preferred embodiment, as shown in FIG. 9, studs 23 have a C-section cross section which may be locally reinforced. A plate 70 may be securely fastened by any of the aforementioned fastening means to flange 71. A C-section reinforcing channel 72, which is shorter in length than flange 71, is placed on top of plate 70 so that it is nested in flange 71. Reinforcement channel 72 may be fastened to flange 71 by any of the aforementioned fastening means. Again reinforcing may be used as necessary in critical areas, i.e., such as the mid-section of stud 23. Of primary importance is to keep the overall weight of each member as small as possible, therefore localized reinforcing is more beneficial than reinforcing along the entire length of a member or by using a heavier gauge member. The table below demonstrates the benefits obtained from local re inforcing of various stud members. In this instance the studs listed in the table are from Jaimes Industries, of Royal Oak, Michigan.

TABLE 1

| Basic Stud or Joist Size | Effect Of Localized Reinforcing | |
|---|---|---|
| | Percent Increase in Weight | Percent Increase in Strength |
| 4C18 | 62% | 131% |
| 6C18 | 49% | 119% |
| 8C18 | 40% | 108% |
| 4C18 | 82% | 163% |
| 6C18 | 65% | 149% |
| 8C18 | 53% | 135% |
| 10C16 | 38% | 95% |
| 10C16 | 47% | 117% |

In accordance with another aspect of the invention, there is provided a bracing means for the area surrounding the doors in the building. Typically, in buildings of this type, there are end doors which are non-load bearing and side doors which are load-bearing.

The end door opening 80 is comprised of a jamb section 81 and a header section 82. Only one side of the door 80 is shown but both sides are symmetrical. Jamb section 81 includes a vertical jamb 83 the upper end of may be cut across which its flanges 85, and then folded or bent at the notched area at a 90° angle with the flanges overlapped to form an L-like member 84. Alternatively, a 45° angle may be cut in flanges 85, such as at the opposite end 86 of jamb 83, and a corresponding 45° angle is cut in base channel 87. The base channel 87 is bent under stud 83 so that the 45° angles are flush whereupon they can be welded together. A support stud 88 extends from base channel 87 to the L-like member 84 adding lateral support to the L-like member.

The header section 82 includes first channel 89 which extends from one L-like member 84 to the other, spanning the doorway opening. A second channel 90 is nested in the first channel 89 to provide additional support and is approximately the same length as channel 89. A third channel 91 is also nested in the first channel 89 and it extends a distance beyond channel 89 until it engages stud 23. In order to mate with stud 23, the third channel 91 is notched at 93 a short distance from one end and then folded downward so that stud 23 nests inside of flanges 94 and abuts channel web 95. Channel 91 also carries wall stud 96 which is above the doorway span.

Figures 12, 13:
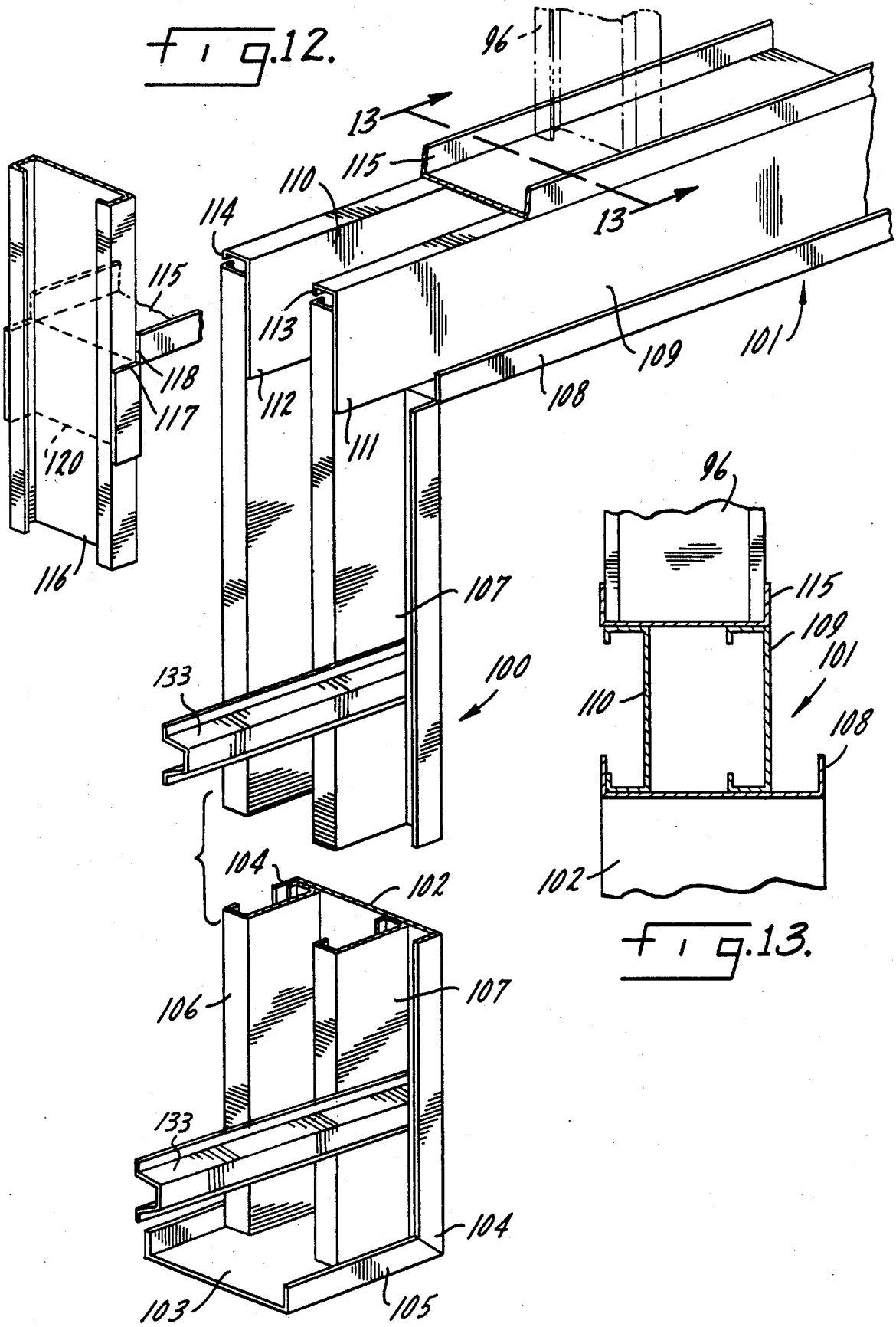
FIG. 12 is a partial perspective view of a load bearing door jamb and header.
FIG. 13 is a fragmentary cross sectional view taken substantially along line 13—13 in FIG. 12 depicting the header section which spans the doorway.

The load bearing door opening, as shown in FIG. 12, is also comprised of a jamb section 100 and a header section 101. The side door opening differs from the aforementioned end door opening in that it is designed to carry building loads. Jamb section 100 includes a vertical jamb 102 which extends from the header section 101 to a base channel 103. A 45° angle is cut in flanges 104 of jamb 102 and a corresponding 45° angle is cut in flanges 105 of base channel 103. Base channel 103 is folded under jamb 102 until the angled section of the respective flanges mate. Support studs 106 and 107 are parallel to each other and extend a short distance above jamb 102 while resting within and on base channel 103. The distance between flange 104 and support stud 107 should be sufficient to allow a support spacer or girt to be installed in that space. Girts will be discussed more fully below.

Header section 101 includes header channel 108 which extends along the doorway opening between jambs 102, one of which is shown in FIG. 12. A pair of support joists 109, 110 extend along the longitudinal axis of header channel 108 and are parallel to each other. Support joists 109, 110 actually extend beyond the ends of header channel 108 and overlap support studs 106, 107. To accomplish the overlap, flanges 111, 112 must be notched a distance at least as long as support studs 109, 110 are wide. The other flanges 113, 114 rest on top of support studs 107, 106, respectively.

To tie the doorway into the wall studs, top channel 115 is provided. It extends along the doorway and mates with first wall stud 116, one of which is located on either side of the doorway. Flanges 118 are notched at 117 a short distance from the end 120 of channel 115 and then end 120 is folded downward at a 90° angle to mate with and surround stud 116.

The door configurations are constructed so that extra trim items normally associated with door openings, such as gussets, brackets or extra thick members, are eliminated. In addition, the jamb sections and header sections can be shop fabricated or built on site, as the situation requires.

In both the side door and end door sections the various support members can be fastened together by any of the aforementioned fastening means. One particular fastening means may be desirable over another, i.e., where appearance is of primary importance, certain fasteners could be hidden from sight; however, regardless of the fastening means, each method has the structural integrity to accomplish the task of coupling the members and maintaining the desired safety factor.

Generally speaking, in buildings of this type, the walls, due to their construction, require cross-bracing, cables, threaded rods, turn-buckles, special connections, special brackets, or other fittings to achieve proper structural integrity. The extra fittings and braces increase both raw material and labor costs as well as add weight to the building. Consequently, to resolve the difficulty the present invention provides for a wall system 130 which requires no special parts or connections and can be used as an end or side wall as well as an interior wall.

Wall system 130 is comprised of a single sheet 131 or double sheet 132 of sheet metal material. The preferred sheet metal siding is a roll formed rib pattern such as "Grand Rib 3" manufactured by Fabral of Lancaster, Pa.

A number of uniformly spaced hat-shaped support spacers 133, commonly referred to as girts, are fastened to sheet 131 so that the girts span the entire width of sheet 131. As illustrated, the girts 133 are perpendicular to the ribs 134 in the sheet and are securely fastened to wall studs 135. It is preferred that girts 133 be fastened to wall studs 135 with conventional self-tapping screws 136 located in legs 137. Conventional self-tapping screws 138 are also preferred when fastening sheets 131 to the girts 133.

Figures 14, 14A, 14B, 15:
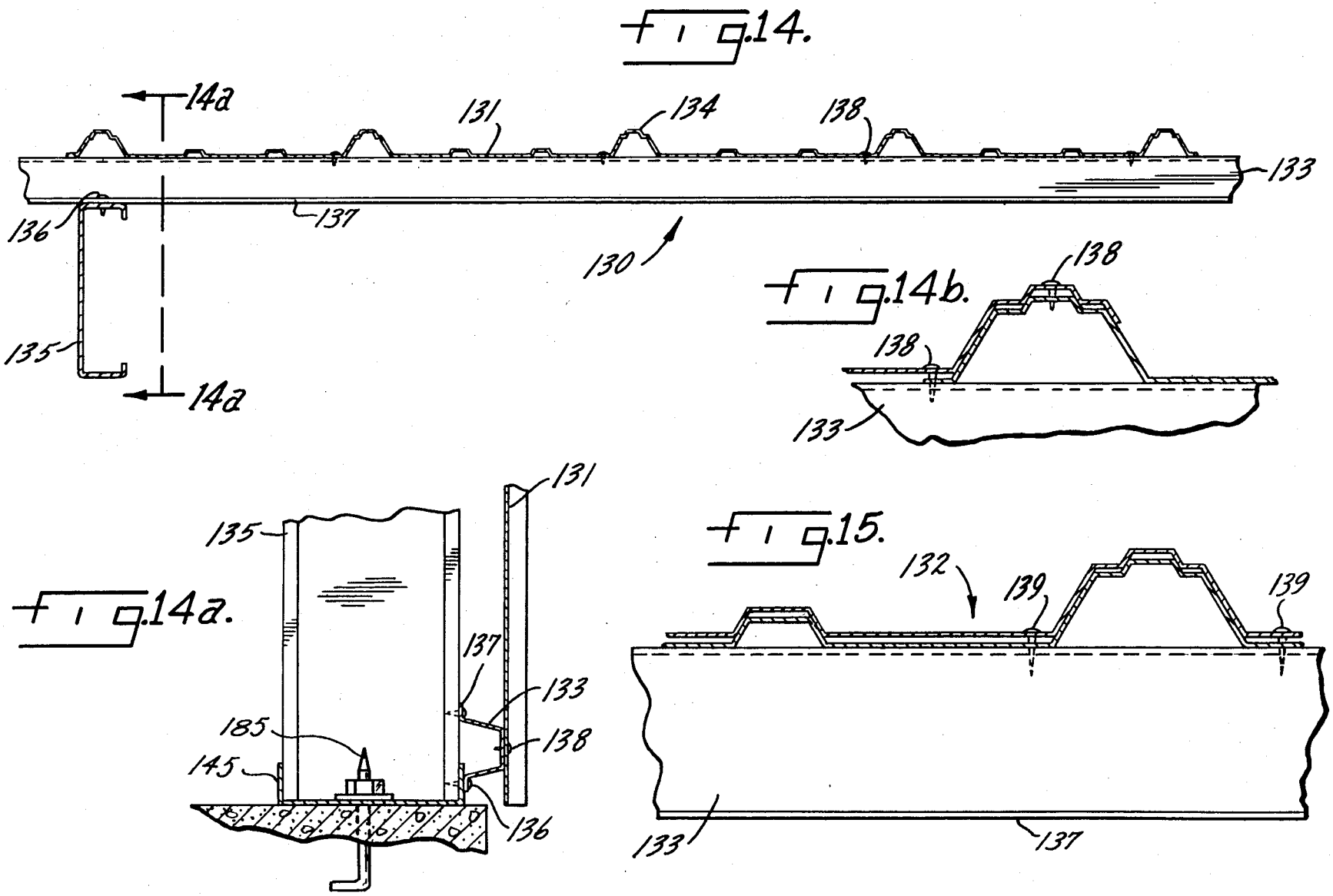
FIG. 14 is an enlarged end view of a single piece of roll formed siding and means of attaching to a wall or roof section.
FIG. 14*a*is a cross-sectional view taken along line 14*a*—14*a* showing the siding, girt and stud.
FIG. 14*b* is a partial end view of siding where two panels overlap.
FIG. 15 is an enlarged end view of two overlapping sheets of roll formed siding and attachment to a girt or purlin.

To substantially increase the strength characteristics of wall system 130, double sheet 132, which is a pair of light gauge roll formed rib sheets, is provided. The ribbed sheets are nested and fastened to each other by conventional self-tapping screws 139. The double sheet 132 is fastened to the wall studs in a manner similar to that used for single sheet 131, using self-tapping screws and girts 133 (see FIG. 15).

By using double sheet 132, the screw spacing and girt spacing can be reduced to significantly increase the overall strength characteristics of wall system 130 without substantially increasing the weight. Table 2 below reflects the increased design strength as a result of using double sheet 132 and reducing the spacing between girts 133. Typically in buildings of this type, the expected design strength ranges from 130 plf (pounds per lineal foot) to about 230 plf.

TABLE 2

| Description | Girt Spacing | Gage | Design Strength |
|---|---|---|---|
| Single sheet | 36" o.c. | 22 ga. | 189 plf. |
| Single sheet | 24" o.c. | 22 ga. | 252.5 plf. |
| Single sheet | 12" o.c. | 22 ga. | 379 plf. |
| Double sheet | 36" o.c. | 18 ga. | 307 plf. |
| Double sheet | 24" o.c. | 18 ga. | 409 plf. |
| Double sheet | 12" o.c. | 18 ga. | 613 plf. |

The screw spacing, girt spacing, and number of wall sheets can be varied to achieve design strengths not available with existing light gauge building structures. As an example, a wall test panel was constructed with two sheets of wall section; screws on 9 inch centers along each girt (i.e., beside each high rib); stitch screws on 12 inch centers along sheet overlaps (in the doubled edge) in the top of the high rib; and edge screws on 12 inch centers at the vertical edges into the girts to simulate sheet laps. This particular wall section was tested to failure and found to have a design strength of approximately 613 pounds per lineal foot. This compares favorably with similar existing structures which have a design strength of approximately 230 pounds per lineal foot.

According to the invention, it is contemplated that wall system 130 will be used for outside walls; however, it can just as easily be used as an interior wall or as a roof without requiring modification of the basic design described above.

In another regard, difficulty is often encountered when securing corner studs or "wind studs" to their corresponding track sections. This aspect of the invention provides for a superior anchorage system of stud-to-track connection than is possible with conventional systems.

Figure 17:
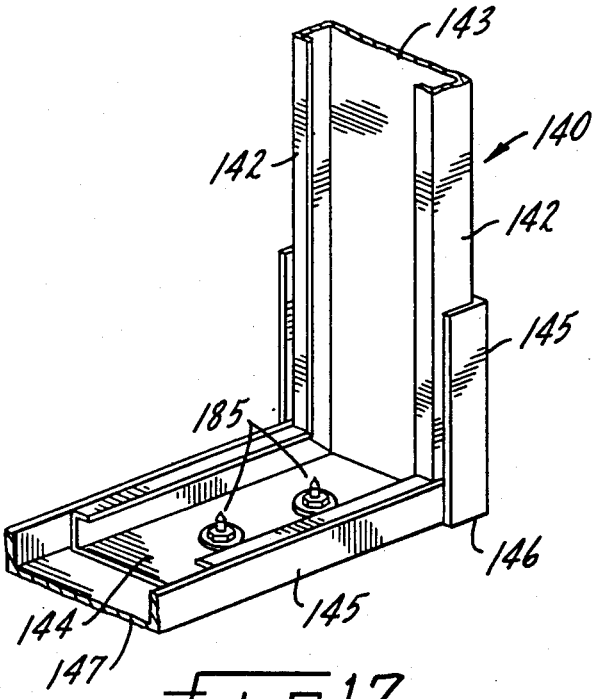
FIG. 17 is a partial perspective view of an L-shaped wind stud and L-shaped track section in place on anchor bolts.
Figure 16:
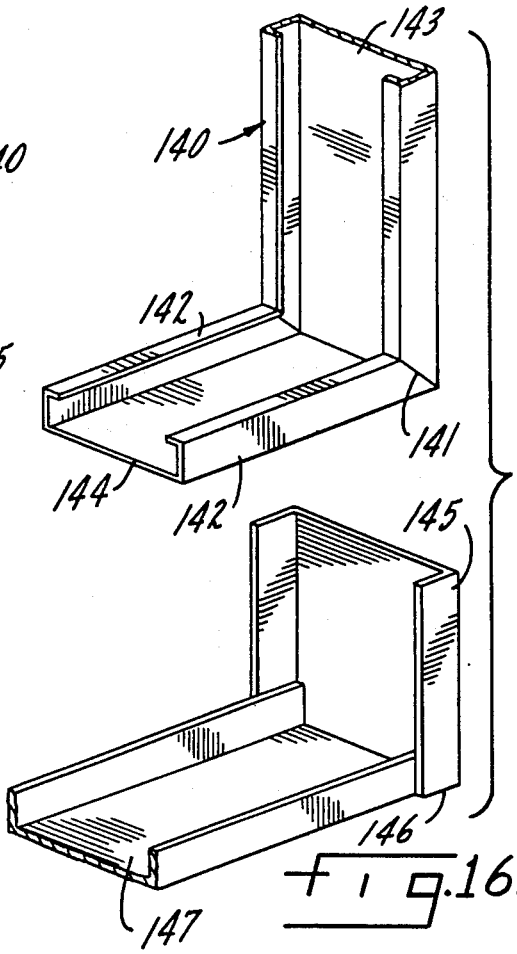
FIG. 16 is an exploded perspective view of an L-shaped wall stud before it is nested in an L-shaped track section.

Pursuant to another aspect of the invention, a conventional stud 140 is provided which has a 90° V-shaped notch 141 cut in its flanges 142. Notch 141 should be cut or torched so as not to weaken the surrounding web 143, and should be located a short distance from end 144. After notch 141 is cut, end 144 is bent 90° so stud 140 resembles an L-shaped member. The notch area 141 is then welded to create a uniform structure. Track channel 145, which is fixed to the concrete foundation (not shown), also has a slot 146 cut a short distance from its end 147. End 147 is bent 90° and notch area 146 is welded to create a uniform L-shaped section. As shown in FIG. 17, stud 140 is nested in track channel 145 so that their respective L-shaped sections overlap. The double thickness created by the L-shaped overlap is especially beneficial when fastening the members together using nuts and bolts as shown, or self-tapping screws (no predrilling or matching holes are necessary), spot welds or other connectors.

Figure 18:
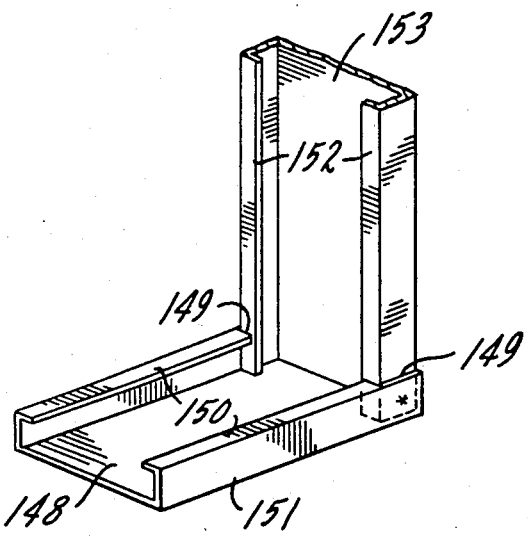
FIG. 18 is a partial perspective view of a wall stud bent 90° after receiving a rectangular notch.
Figure 16A:
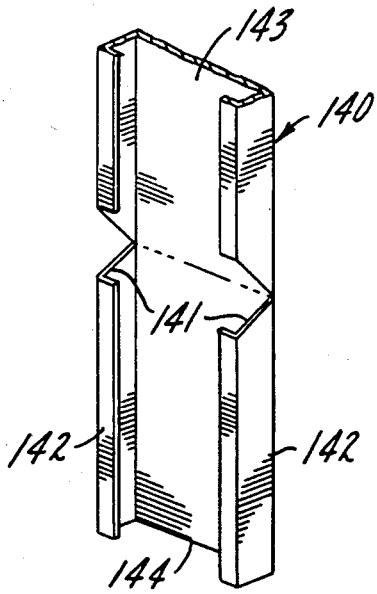
FIG. 16*a* is a detailed perspective view of the wall stud with its 90° V-shaped notch before it is bent into an L-like member.

As an alternative to the "wind stud" just described, stud 148 shown in FIG. 18 has a rectangular notch 149 cut in flanges 150. The notch 149 spans a distance approximately equal to the thickness of the flanges 152. After cutting the notch, end 151 is bent 90° so stud 148 forms an L-like member. The mating surfaces can then be fastened with self-tapping screws, spot welds, or other connecting means and stud 148 can be nested in the L-like member of track channel 145.

An advantage not readily apparent from the above description is that the track sections and studs can consist of lighter gauge material than is possible with conventional buildings. In addition, predrilled anchor bolt holes are not necessary in the track section because the holes can be punched in the light gauge material on site. A still further advantage is that the respective L-shaped sections can be varied in length to increase the overlap, thereby increasing the overall strength of the connection as well as providing a greater surface area for fasteners and connectors.

A further aspect of the invention provides for a pointed or semi-pointed anchor bolt 185 which is partially embedded in concrete foundation 24. The pointed end is threaded and projects out of the foundation 24 and, when installing track section 156, the anchor bolt 185 will pierce the track section. Conventional buildings do not provide a means for piercing the track section but instead rely on predrilled holes in the section.

There are alignment problems with predrilled holes which do not arise with the present invention.

Figure 20:
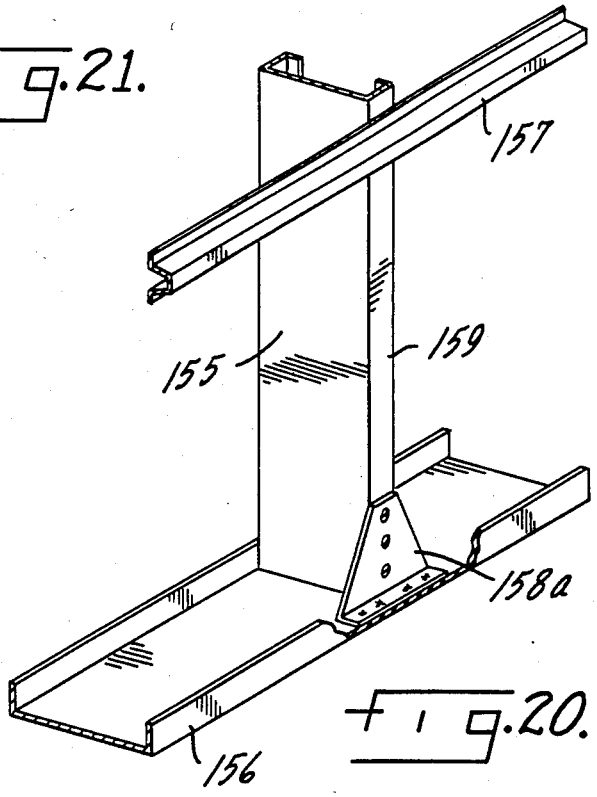
FIG. 20 is a partial perspective view of a modified clip embodiment which ties the wall stud to the track section.
Figure 19B:
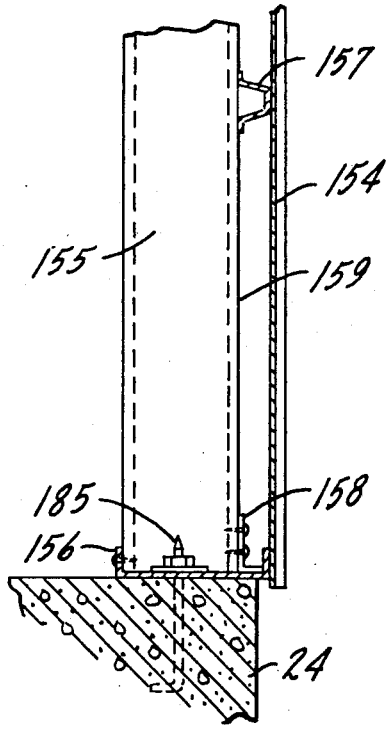
FIG. 19*b* is a partial cross sectional view taken substantially along line 19*b*—19*b* in FIG. 19*a* showing how the wall stud and-wall siding tie into the track section.
Figure 19A:
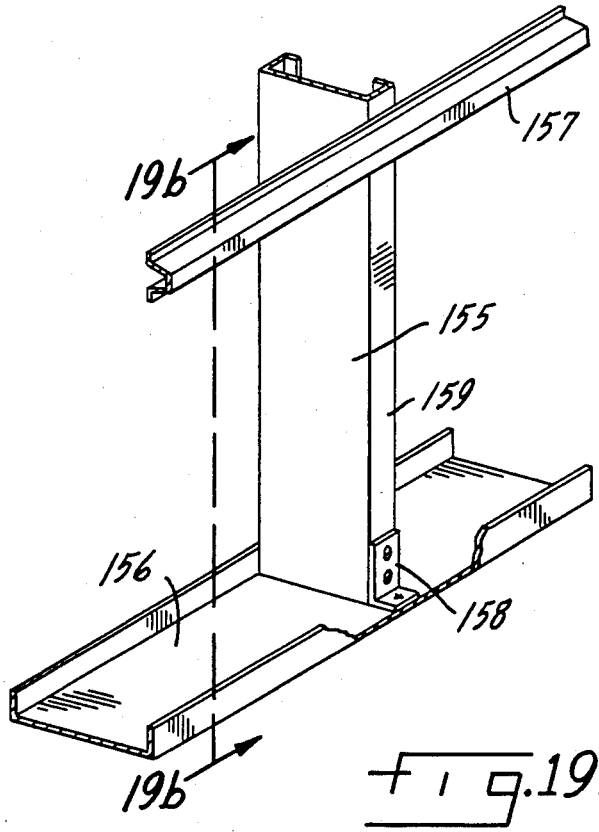
FIG. 19*a* is a partial perspective view of a clip which ties the wall stud to the track section.

In buildings of this type, it is normal practice to provide a girt 157 along the bottom track section so that the outside wall can be fastened to the girt. The problem with this is that the girt must be screwed into the track section at the building site where installation is difficult due to closely spaced and hard to reach connections. This problem is essentially overcome where provision is made for connecting a wall stud 155 to a track section 156 at any location along the wall. Track section 156 is wider than the thickness of wall stud 155 by a distance substantially equal to the thickness of girt 157. A light gauge angle clip 158, also equal to the thickness of girt 157, abuts flange 159 of the stud 155 and track section 156 (cut away for clarity). As shown in FIG. 19*b*, wall 154 is fastened to the exterior flange of track section 156 and girt 157 and therefore remains parallel to wall studs 155. The wall 154 does not mate with clip 158. The clip 158 can be fastened to flange 159 of the stud 155 and track 156 using self-tapping screws. Clip 158 need not be exactly as wide as flange 159 but may be wider and longer as shown in FIG. 20 by clip 158*a*. Both types of clips shown permit a much better connection against uplift, which is the tendency of the wall stud to pull away from the track section, than does conventional stud-to-track connections. The wall 154 is fastened directly to the track section which eliminates the need for a track girt.

Figure 21:
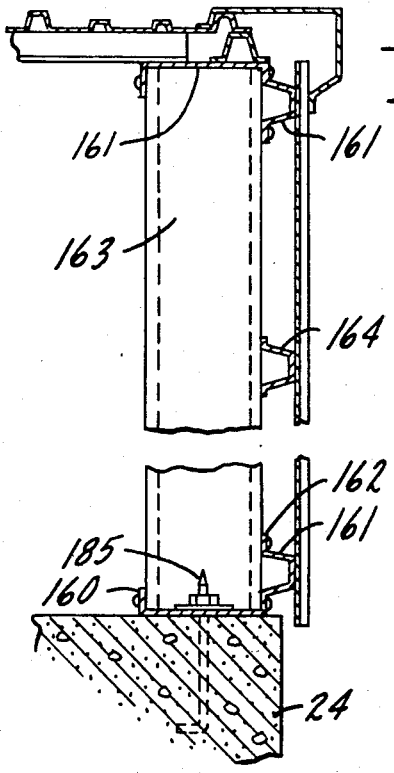
FIG. 21 is a partial cross sectional view of a modified integral track hat section as it ties into the wall stud and wall siding.

As an alternative to the angle clip 158, means may be provided for an integral track hat section 160 which serves as a track section and a girt. Track section 160 can be either roll-formed or pressed on a brake, using light gauge steel, to conform flange 161 into a shape corresponding to a typical hat-shaped girt. Leg 162 abuts wall stud 163 and is fastened thereto using conventional self-tapping screws. Flange 161 extends a distance equal to the height of girt 164. Wall 165 is then fastened to flange 161 and girt 164 with self-tapping screws. A similar integral track hat section 160 can be inverted and installed on the top ends of the studs 163 as shown in FIG. 21.

A unitary purlin-girt 171 (referred to as a pur girt) can also be used along the top of the gable studs 167 (FIG. 22). It is contemplated that track section 166 run only atop gable studs 167 and not atop side wall studs because of the misalignment which is created by the slope of the roof where it runs into the eave.

Both integral track sections provide the same advantages, i.e., elimination of a labor intensive separate track section and bottom or top girt. Further, an integral track section is structurally superior over a separate track section with a girt fastened to it with screws because of its one piece construction.

A problem often encountered in light gauge steel buildings is that it is difficult to get an efficient, yet structurally sound, mating relationship where the roof meets the wall at the eave and where the roof sections meet each other at the ridge or peak. The present invention provides for a ridge purlin 170 and an eave purlin 171 which are a means for mating the roof sections and the roof and wall sections. Intermediate purlins 172 are provided between the ridge purlin 170 and eave purlin 171.

Roof sections 173 approach each other at the ridge 174 but do not touch or intersect. The roof purlin 170 is roll-formed or pressed on a brake using light gauge steel which results in a uniform single piece support spacer. Conventional self-tapping screws are used to fasten roof sections 173 to roof purlin 170 and its legs 175 to top chords 176. Generally, tying roof sections 173 together would be accomplished using two purlins, one on each side of ridge 174. As would be suspected, the conventional method is more time consuming to install and results in a weaker structure than that provided by the present invention.

Roof sections 173 slope downward and extend past outside side wall 177 to create an overhang. Eave purlin 171 mates the roof section 173 and the outside side wall 177 to close gap 178 where the roof and wall intersect. Conventional self-tapping screws can be used to fasten eave purlin 171 to roof section 173 and to outside wall 177. The legs 179, 180 of the eave purlin 171 are fastened to top chord 176 and reinforcing channel 182 using self-drilling screws. An eave trim 183 covers the gap 178 to prevent moisture from entering. Again, the advantages of using an eave purlin 171 are its single piece construction, which adds structural strength in the mating area not available with conventional buildings, and the ease of installation compared to two piece systems.

The present invention is also concerned with providing a means for tying the roof sections to the outside end wall along the gable. Some building systems may provide for all end wall studs to be of uniform length with a truss or special gable frame above them. A truss or gable frame in this area is not necessary and it adds weight in a section of the building where it is least desired.

The present invention calls for gable studs 190 which increase in length proportionate to the slope of the roof so that each stud 190 extends from the bottom track (not shown) approximately to the roof (see FIG. 25). Track 191 fits over studs 190 like a cap and is fastened thereto with self-drilling screws. Girt 192 runs parallel to the slope of roof 193 and along track 191 and gable studs 190. Self-drilling screws are used to fasten legs 194 to stud 190 and gable wall 195 to girt 192. Also, discontinuous edge purlins 196, which are fixed to track 191, are interrupted by continuous roof purlins 197 that are spaced apart from the peak of the roof to the eave. Purlins 197 add strength without significantly increasing weight. A preformed edge or end cap 198 closes the opening between the roof 193 and gable wall 195.

An alternative to this aspect of the invention is to provide a track section 200, shown in FIG. 26, which is wider than gable studs 201, and fits over studs 201 like a cap. Self-drilling screws may be used to affix track 200 to studs 201 at flange 202 and clip 203. Gable wall 204 is affixed directly to track 200 using self-tapping screws. A continuous purlin 205 is affixed to track 200 and extends from the eave to the peak of the roof. The legs are fastened to the track 200 and to the roof 207 using self-drilling screws. Continuous roof purlins 208 stop just short of abutting purlin 205 and are to be affixed to track 200 with self-drilling self-tapping screws.

We claim:

1. A light gauge metal building system composed of roll-formed sheet metal structural components and associated fastening means, said system comprising, in combination, (a) truss means having a plurality of member including top and bottom chords having generally C-shaped crosssection with top and bottom flanges interconnected by substantially flat web sections, the top and bottom chord members being arranged in interescting realtionship to each other with the top flange of the bottom chord being notched to receive the bottom flange and web of an interescting top chord so that the two chords can overlap and be securely fixed to each other with the top and bottom flanges thereof projecting away from the webs in the same direction, (b) roof means including roll-formed roof purlins for fastening the truss means to one another in spaced apart relation, (c) a wall system including a plurality of roll-formed generally C-shaped wall studs and a plurality of roll-formed horizontal support girts, each support girt being spaced a predetermined distance from the next one and securely fastened to the wall studs, and (d) means for connecting the wall system to the roof means where the two intersect.

2. The building system as defined in claim 1 including a plurality of roll-formed generally channel-shaped bottom track sections, and wherein the means for fastening the wall studs to the track sections includes cutting a V-shaped notch in the flanges of the wall stub and cuts in the flanges of the track section, and bending the notched ends 90° to form an L-like member, then mating the two L-like members in overlapping fashion and fastening the same together.

3. The building system as definded in claim 1 including a plurality of roll-formed generally channel-shaped bottom track sections, and wherein the means for fastening the wall studs to the bottom track sections includes a rectangular notch in the flanges of the wall stud mating the notched area with the track section flanges and fastening the abutting members together.

4. The building system as defined in claim 1 including roof means including a plurality of metal sheets supported by said truss means and roof purlins and wherein means for connecting the roof sections where they abut at the peak of the roof includes a continuous hat-shaped support spacer having a pair of legs, one surface of which is securely fixed to each side of the roof at the peak while the legs of the hat-shaped support spacer are fastened to the top chord of the truss members.

5. The building system defined in claim 1 including a plurality of reinforcing members securely fastened to the chords to increase their strength.

6. The building system defined in claim 1 including a plurality of eave joint stiffening members connected to the ends of the top and bottom chords where they intersect.

7. The building system defined in claim 1 including a plurality of door jambs, each door jamb having support studs with a front flange and a rear flange, a first channel being in parallel mating relationship with the support stubs and abutting the front flange and one surface of the support studs and a second channel being spaced apart from the first channel and in parallel relationship and affixed to the support studs.

8. The building system defined in claim 7 including a header section having a pair of parallel spaced-apart channels extending a distance longer than the ends of the header section and intersection with the first and second channels, the header section being substantially perpendicular to the support stud.

9. The building system defined in claim 1 wherein the means for connecting the wall system to the roof means includes a plurality of roll-formed combination elongated purgirts having a substantially hat shaped purlin portion integrally joined along its longitudinal edge to a substantially hat shaped girt portion.

10. The building system as defined in claim 1 including means for reinforcing the studs including a channel-shaped member nested within the generally C-shaped studs.

11. The building system as defined in claim 10 including means for reinforcing the studs including a flat reinforcing plate sandwiched between the channel-shaped reinforcing member and the stud.

12. Light gauge metal truss means for a building system, said truss means comprising a plurality of roll-formed sheet metal components including top and bottom chords having generally C-shaped cross-sections with top and bottom flanges interconnected by substantially flat web sections, the top and bottom chord members being arrange at one end in intersecting relationship to each other with the top flange of the bottom chord being notched to receive the bottom flange and web of an intersecting top chord so that the two chords can overlap and be securely fixed to each other in web to web engagement with the top and bottom flanges thereof projecting away from the respective webs in the same direction, the bottom flange of at least one of the top chords being notched to receive the bottom flange and web of the other top chord so that the two top chords can overlap and be securely fixed to each other in web to web engagement with the top and bottom flanges thereof projecting away from the respective webs in the same direction, a peak gusset having at least one flat web section, a pair of eave joint stiffeners having generally channel-shaped cross-sections with side flanges interconnected by substantially flat web section, said peak gusset secured to the intersecting top chords in web to web engagement, and said eave stiffeners secured to the notched ends of said lower chords in web to web engagement therewith and with the flanges of the eave joint stiffeners projecting in the opposite direction to the flanges of the intersecting chord members.

13. A light gauge metal truss means as defined in claim 16 including a plurality of roll-formed generally C-shaped compression members with side flanges interconnected by substantially flat web section, the compression members being arranged to overlap the top and bottom chord member in web to web engagement with the flanges of the compression members projecting in the opposite direction to the flanges of the chord members.

14. A light gauge metal truss means as defined in claim 13 including at least one reinforcing compression member having a roll-formed generally C-shaped cross section with side flanges interconnected by a substantially flat web section, said reinforcing compression member being disposed in web to web engagement with one of said other compression member.

15. A light gauge metal truss means as defined in claim 12 including a plurality of roll-formed chord reinforcing elements having generally channel shaped cross sections the webs of which are adapted to be secured in face to face engagement with the flanges of one of said chord members.

16. A light gauge metal truss means as defined in claim 12 including a plurality of roll-formed generally C-shaped tension members with side flanges interconnected by substantially flat web sections, the tension members being arranged to overlap the top and bottom chord members in web to web engagement with the flanges of the tension members projecting in the opposition direction to the flanges of the chord members.

17. A light gauge metal truss means as defined in claim 12 including a generally channel-shaped reinforcing splice member for surrounding and engaging the ends of the bottom chords in web to web relation.

18. A light gauge metal truss means as defined in claim 12 including a generally C-shaped reinforcing splice member nested within and engaging the ends of the bottom chords in web to web relation.

19. A light gauge metal truss means as defined in claim 12 including a plurality of roll-formed genrally C-shaped tension members with said flanges interconnected by substantially flat web sections, the flanges at least at one end of the tension members being cut away and the tension members being arranged to overlap at least one of the top and bottom chord members in web to web engagement with the flanges of the tension members projecting in the same direction as the flanges of the chord members.

20. A light gauge metal truss means as defined in claim 19 wherein said one end of the tension member is arranged to overlap the bottom chord member in web to web engagement and the other end of the tension member is arranged to overlap the peak gusset in web to web engagement.

* * * * *